US008544401B2

(12) United States Patent
Arote

(10) Patent No.: US 8,544,401 B2
(45) Date of Patent: Oct. 1, 2013

(54) CLEAT ATTACHABLE DEVICE

(76) Inventor: Richard Arote, Lynbrook, NY (US)

( * ) Notice: Subject to any disclaimer, the term of this patent is extended or adjusted under 35 U.S.C. 154(b) by 246 days.

(21) Appl. No.: 13/030,254

(22) Filed: Feb. 18, 2011

(65) Prior Publication Data

US 2012/0017818 A1 Jan. 26, 2012

Related U.S. Application Data

(60) Provisional application No. 61/367,497, filed on Jul. 26, 2010.

(51) Int. Cl.
*B63B 21/04* (2006.01)

(52) U.S. Cl.
USPC ..... 114/218; 114/230.26

(58) Field of Classification Search
USPC ..... 114/218, 230.26, 343, 364; D12/317
See application file for complete search history.

(56) References Cited

U.S. PATENT DOCUMENTS

| | | | | |
|---|---|---|---|---|
| 2,900,689 | A | 8/1959 | Pearson | |
| 3,507,243 | A | 4/1970 | Brown | |
| 4,095,548 | A | 6/1978 | Bruner | |
| 4,488,502 | A | 12/1984 | Girard | |
| 4,706,594 | A | 11/1987 | Burns | |
| 5,230,295 | A | 7/1993 | Shell | |
| 5,564,670 | A | 10/1996 | Dysarz | |
| 6,155,191 | A | 12/2000 | Weaver | |
| 6,168,160 | B1 | 1/2001 | DeOreo et al. | |
| 6,568,648 | B1 | 5/2003 | Ray | |
| 7,603,960 | B1 * | 10/2009 | Perry et al. | 114/364 |
| 2004/0237867 | A1 | 12/2004 | Dunn | |
| 2008/0105800 | A1 | 5/2008 | Menning et al. | |

* cited by examiner

*Primary Examiner* — Edwin Swinehart

(74) *Attorney, Agent, or Firm* — Robert M. Schwartz

(57) ABSTRACT

A cleat attachable device for attachment to a cleat with horns. The device includes a frame having a base end, a distal end, a center post, and lateral posts. The lateral posts are disposed opposite one another and connected to the center post. The lateral posts each have a respective outer edge opposite one another. The outer edges are spaced apart at the base end at a distance. The distance is at least as great as a length of the horns. The center post has a mounting end projecting beyond the lateral sides at the base end. The mounting end is configured for mounting to the cleat.

15 Claims, 6 Drawing Sheets

(SECTION A-A OF FIG.1)

CLEAT ATTACHABLE DEVICE

CROSS-REFERENCE TO RELATED APPLICATIONS

This application claims the benefit of U.S. Provisional Application Ser. No. 61/367,497, filed on Jul. 26, 2010, entitled Cleat; the prior application is herewith incorporated by reference in its entirety.

BACKGROUND OF THE INVENTION

1. Field of the Invention

The invention relates to a device for attaching to a cleat, more specifically, to a frame device for assisting in attaching a docking line with a looped end.

2. Description of the Related Art

The present invention embodies a frame device for assisting in attaching a docking line with a looped end.

Horn cleats or devices for attaching lines are used generally on docks. Docks generally have a side which allows for a vessel to pull up and tie up to the dock. Horn cleats, well known in the art, are typically made of a metal and include two horns affixed to spars, an opening may be present in the center of the cleat between the spars.

U.S. Pat. No. 6,155,191 to Weaver discloses a cleat bracket having a first end with a z-shape, which allows the bracket to be attached to the cleat. The bracket includes a straight portion having a hook for holding accessories such as a lantern. The bracket of Weaver is not suitable for assisting in placing a loop of a line around horns of the cleat.

SUMMARY OF THE INVENTION

It is accordingly an object of the invention to provide a cleat attachable device which overcomes the above-mentioned disadvantages of the heretofore-known devices of this general type and which provides a device for assisting in attaching a docking line with a looped end, which is easy-to-use and easy to assemble.

With the foregoing and other objects in view there is provided, in accordance with the invention a cleat attachable device for attachment to a cleat with horns. The device includes a frame having a base end, a distal end, a center post, and lateral posts. The lateral posts are disposed opposite one another and connected to the center post. The lateral posts each have a respective outer edge opposite one another. The outer edges are spaced apart at the base end at a distance. The distance is at least as great as a length of the horns. The center post has a mounting end projecting beyond the lateral sides at the base end. The mounting end is configured for mounting to the cleat.

In accordance with another feature of the invention, the lateral posts converge together in a direction towards the distal end.

In accordance with a further feature of the invention, the lateral posts are mounted to one another and to the center post at the distal end.

In accordance with an added feature of the invention, a crossmember is disposed at the base end, the crossmember is attached to the lateral posts by opposite ends of the crossmember.

In accordance with an additional feature of the invention, the lateral posts are pivotable with respect to one another about a pivot at the distal end and the crossmember has a length that is adjustable to accommodate different positions of the lateral posts.

In accordance with another mode of the invention, the lateral posts each have a respective receptacle disposed at the base end. The receptacles each are configured for receiving respective ends of the horns therein.

In accordance with a further mode of the invention, one-way line locking devices are pivotably disposed at the base end. The one-way locking device being pivotable towards the center post.

In accordance with an additional mode of the invention, the mounting end has two legs which straddle the crossmember, and configured to straddle the cleat.

In accordance with still a further mode of the invention, a distal crossmember is disposed at the distal end of the frame. The distal crossmember is attached to the center post. The lateral posts are attached at opposite ends of the distal crossmember.

In accordance with another mode of the invention, each of the lateral posts has a respective receptacle disposed thereon at the base end, the receptacles being configured for receiving a respective end of the horn.

In accordance with yet another mode of the invention, the mounting end has two legs configured to straddle the cleat.

With the objects of the invention in view, there is also provided a cleat attachable device for attaching to a cleat, the cleat having horns. The device includes a frame having a base end, a distal end opposite the base end, and opposing lateral posts extending between the base end and the distal end. The lateral posts each have a respective outer edge opposite one another. The outer edges are spaced apart at the base end at a distance. The distance is at least as great as a length of the horns. A mounting device is connected to the lateral posts and projects beyond the lateral posts in a direction away from the base end.

In accordance with yet another feature of the invention, the lateral posts converge together in a direction towards the distal end.

Other features which are considered as characteristic for the invention are set forth in the appended claims.

Although the invention is illustrated and described herein as embodied in a cleat attachable device, it is nevertheless not intended to be limited to the details shown, since various modifications and structural changes may be made therein without departing from the spirit of the invention and within the scope and range of equivalents of the claims.

The construction and method of operation of the device, however, together with additional objects and advantages thereof will be best understood from the following description of specific embodiments when read in connection with the accompanying drawings.

DESCRIPTION OF THE PREFERRED EMBODIMENTS

Figure 1:
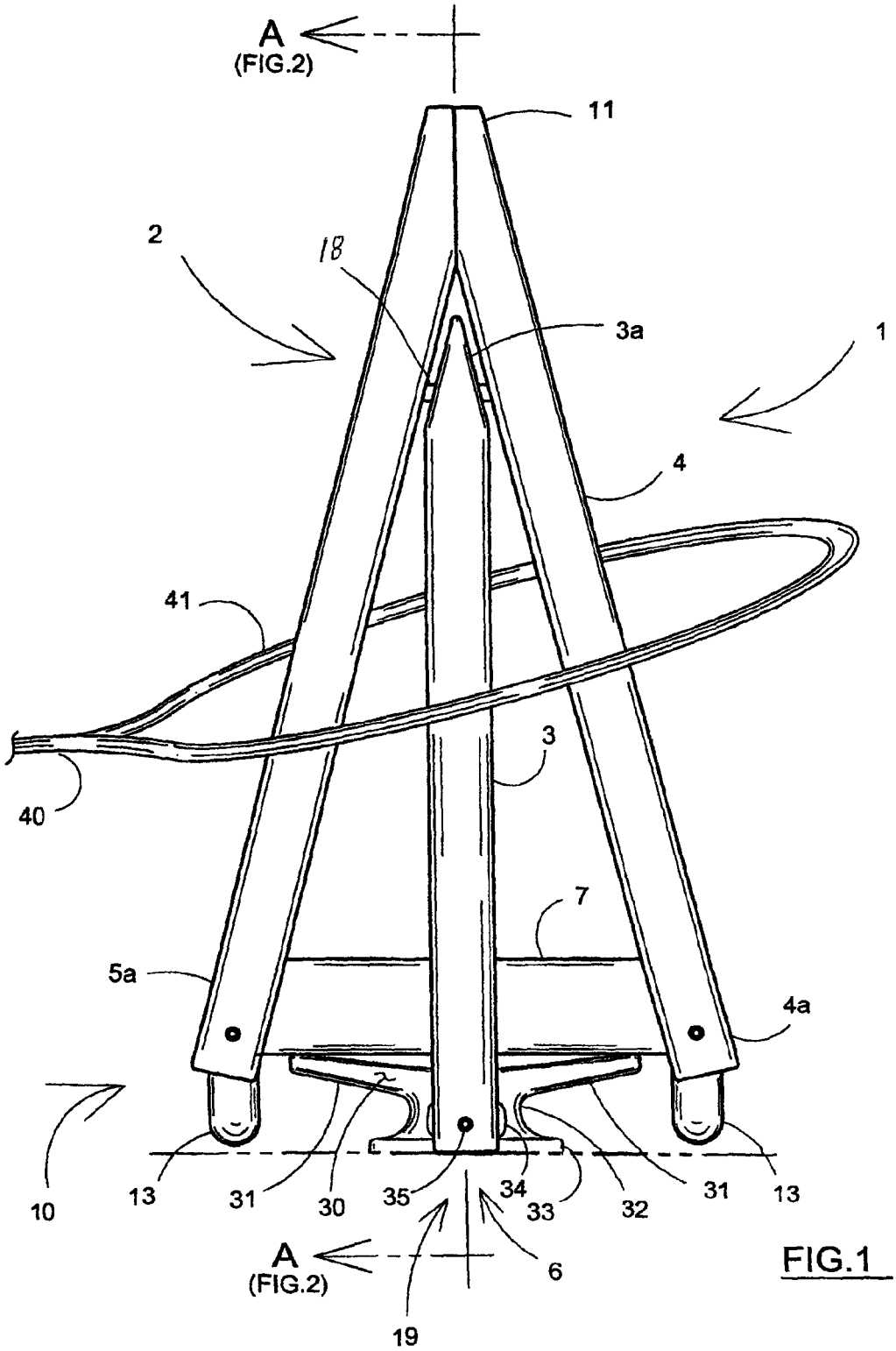
FIG. 1 is side elevational view of the of the device mounted on a cleat.

Referring now to the figures of the drawing in detail and first, particularly, to FIG. 1 thereof, there is seen a cleat attachable device 1 having a frame 2. The device 1 is shown mounted on a cleat 30 which has horns 31, spars 32, a mounting foot 33 and opening 34 between the spars 32. The frame 2 can include a center post 3 and lateral posts 4, 5 disposed on opposite sides of the center post 3. The frame 2 has a base end 10 configured to be mounted to the cleat 30 and a distal end 11 opposite the base end 10. The lateral posts 4, 5 can be mirror symmetric with respect to the center post 3. The frame 2 has a mounting device 19 configured to engage the cleat for mounting the frame 2 to the cleat 30. In FIG. 1 the mounting device 19 is provided by the center post 3 having a base end 6 which projects beyond the lateral posts 4, 5 in a direction away from the frame 2. A crossmember 7 may be provided between the lateral posts 4, 5 and is configured to rest upon the horns 31 of the cleat 30.

Figure 2:
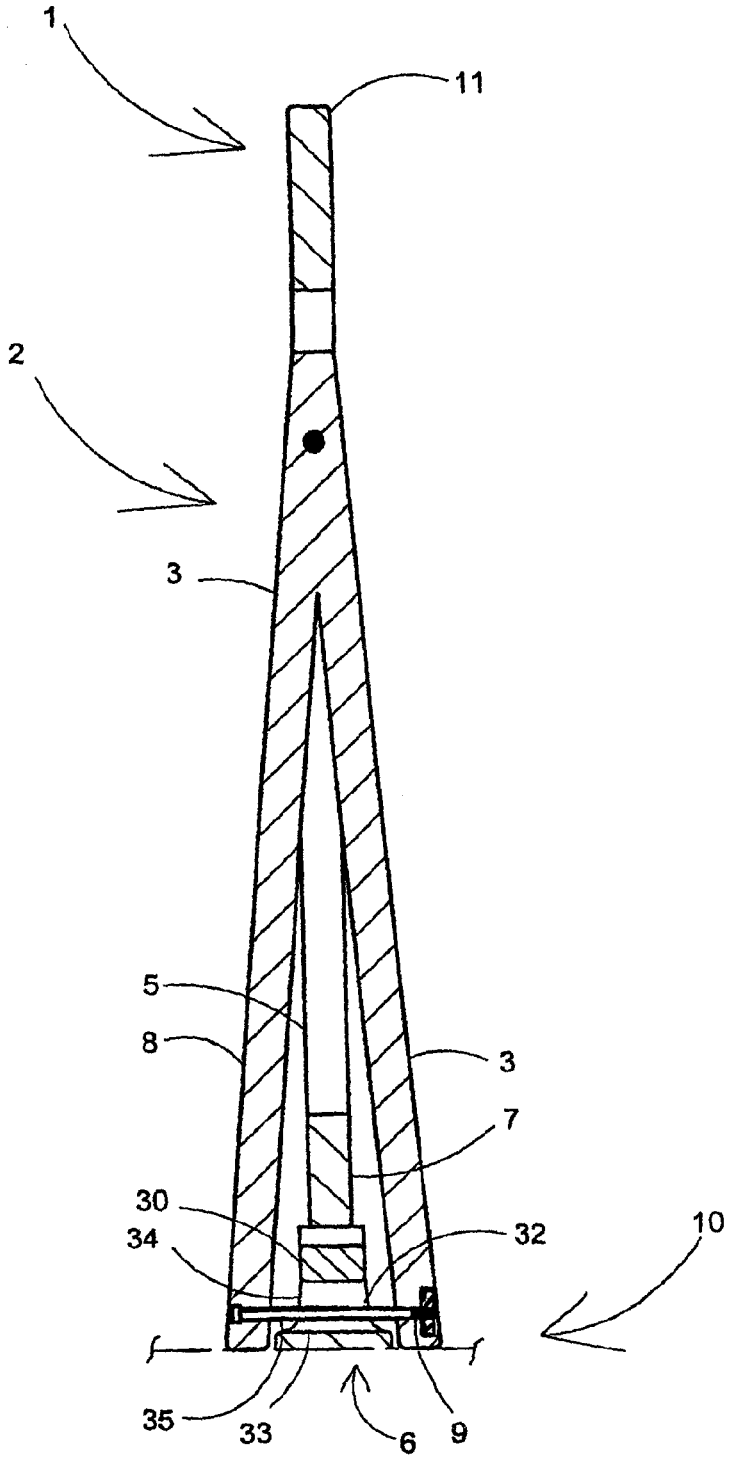
FIG. 2 is a section view through the center of the device according to FIG. 1 mounted on the cleat.

As shown in FIG. 2, the center post 3 may have two legs 8 at the base end 6, which straddle the crossmember 7 and the cleat 30, which can serve as the mounting device 19. The legs 8 of the center post 3 have an opening 9 formed therein for receiving a fastening element 35 which passes through the opening 34 of the cleat 30. It is also possible to provide the center post 3 with one of the legs 8 together with a fastening element 35 which includes a plate or washer which is sized not to be able to pass through the opening 34 of the cleat 30. FIG. 1 shows that the lateral posts 4, 5 are spaced such that outer edges 4*a*, 5*a* thereof extend beyond ends of the horns 31 for allowing a loop 41 of a line 40 to pass over the ends of the horns 31, which results in the line 40 being secured on the cleat 30 around the spars 32. Here, the lateral posts 4, 5 and the center post 3 are disposed in a substantially common plane for allowing the device 1 to properly mount on the cleat 30.

The base end 10 of the frame 2 may include one-way line locking devices 13 disposed at the lateral posts 4, 5. The line locking devices 13 are configured to move towards the spars 32 for allowing the line 40 to pass under the respective horn 31. The locking devices are pivoted back to a locking position by gravity or by an internal spring (not shown) for securing the line 40 between the respective spar 32 and locking device 13 once the line 40 has moved past the respective locking device 13. A stop prevents the locking devices 13 from moving beyond the locking position.

FIG. 1 shows that the lateral posts 4, 5 converge and abut one another and are secured to one another at the distal end 11, which provides the frame 2 with a triangular shape. The outer edges 4*a*, 5*a* may be tapered at the distal end 11 in order to provide an easier target for the loop 41. The center post 3 may also extend towards the distal end 11 and have a tip 3*a* with a profile which corresponds to the angle at which the lateral posts 4, 5 converge. The center post 3 can be fastened to the lateral posts 4, 5 at the tip.

Figure 3A:
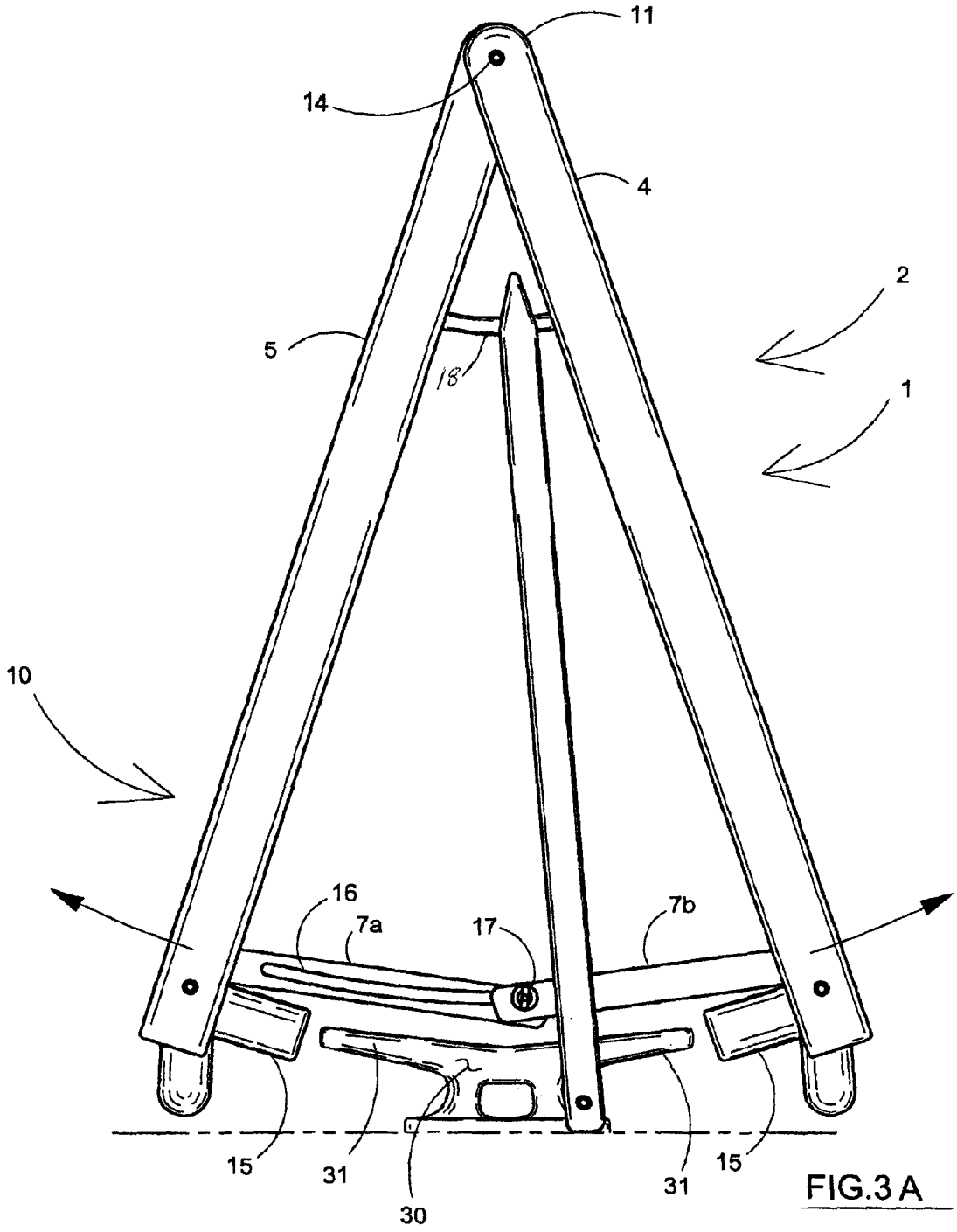
FIG. 3*a* is a side elevational view of a second embodiment of the device prior to being mounted on a cleat.
Figure 3B:
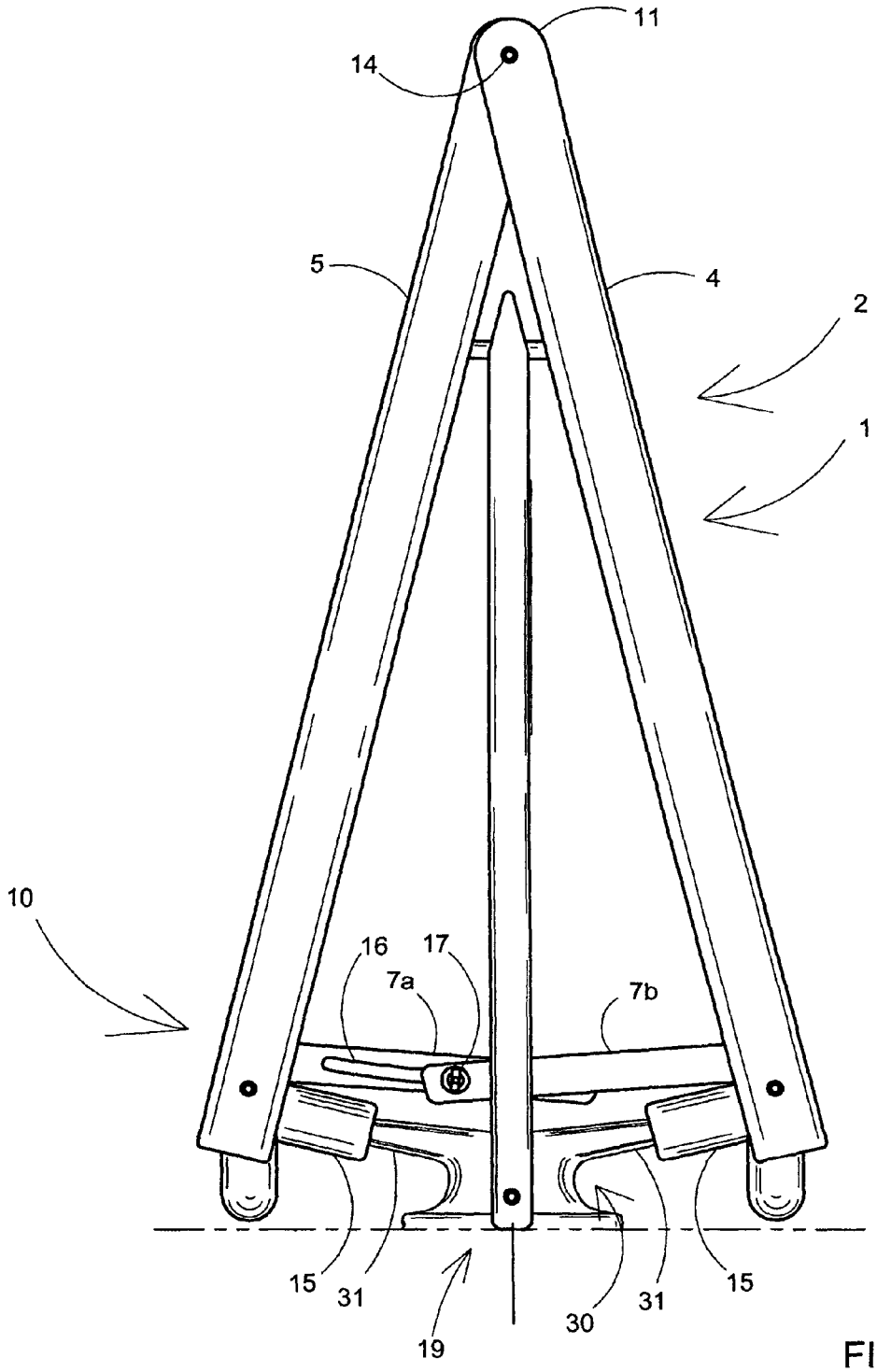
FIG. 3*b* is a side elevational view of a second embodiment of the device mounted on a cleat.

FIG. 3 shows a second embodiment in which the lateral posts 4, 5 are pivotable with respect to one another about a pivot 14 at the distal end 11 in order to allow the cleat attachable device 1 to mount on cleats different sizes (i.e. longer horns). The lateral posts 4, 5 can each have a respective receptacle 15 disposed thereon at the base end 10. The receptacles 15 are configured for receiving ends of the horns 31 therein in order to assist in securely affixing the frame 2 to the cleat 30. Additionally, the crossmember 7 is provided as 2 pieces which can be adjusted in locked in different positions. In FIG. 3 this is achieved by one crossmember 7*a* having a slot 16 formed therein, while the other crossmember 7*b* includes a fastener 17 which engages the slot 16 to lock the crossmembers in a desired position corresponding to the size of the cleat 30 (i.e. the length of the horns 31).

Figure 4:
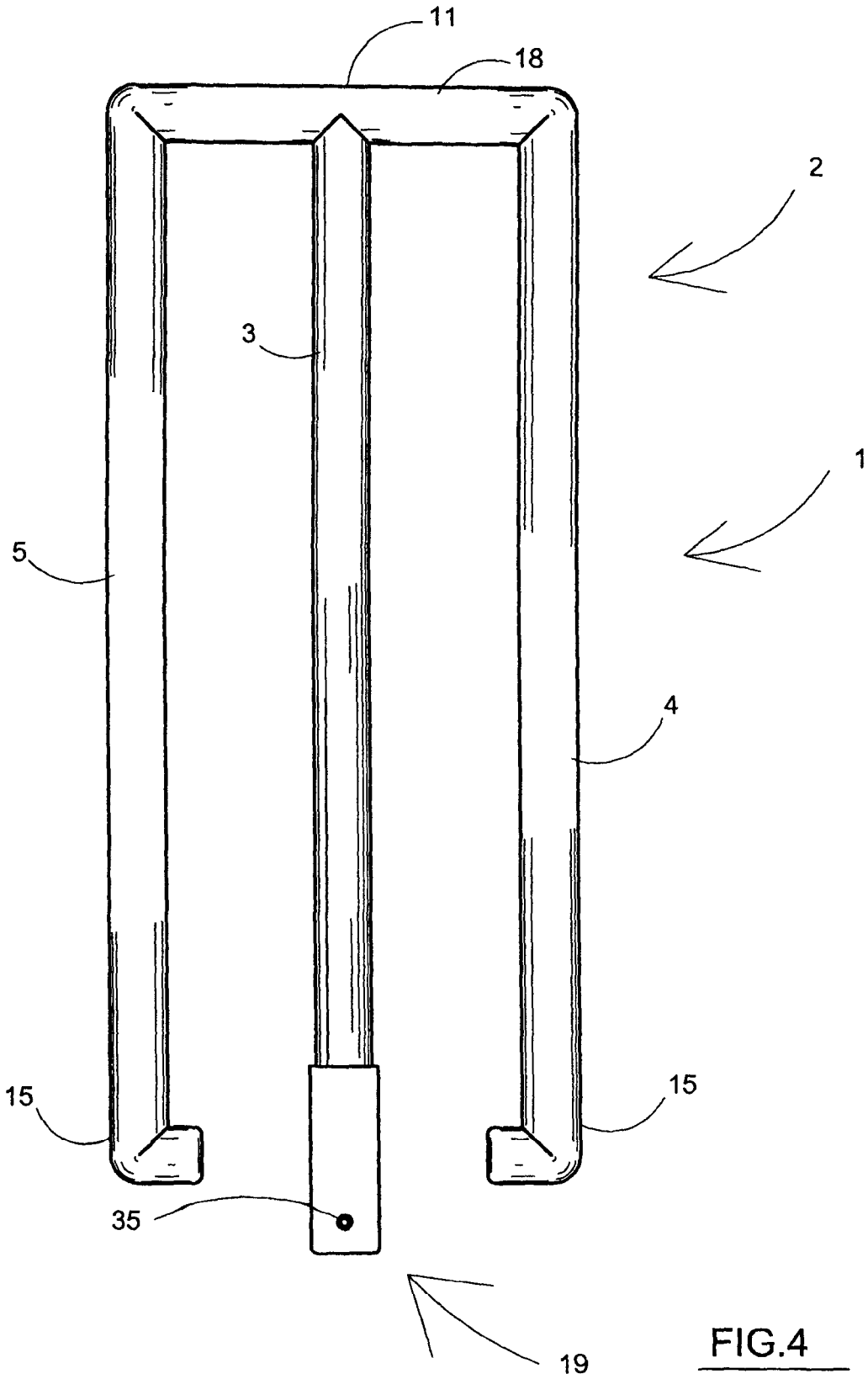
FIG. 4 is a side elevational view of a third embodiment of the device in an unmounted state.
Figure 5:
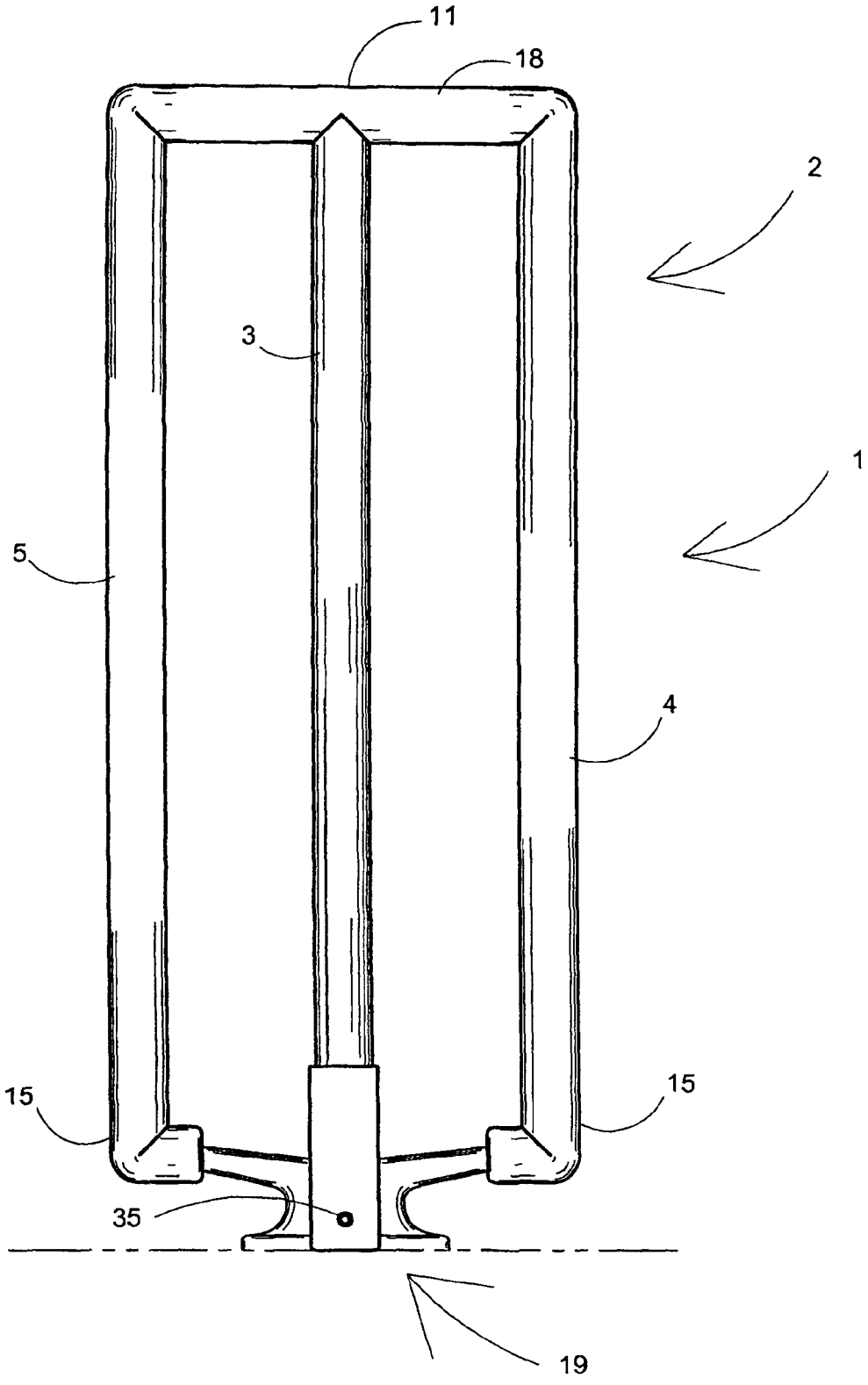
FIG. 5 is a side elevational view of a third embodiment of the device mounted on a cleat.

FIGS. 4 and 5 show a third embodiment of the cleat attachable device 1. Here, the lateral posts 4, 5 are attached to the center post 3 only at the distal end 11 of the frame 2. The distal end 11 of the frame is provided with a distal crossmember 18, which attaches the center post 3 to the lateral posts 4, 5. The lateral posts 4, 5 can either be of a flexible material or pivotable at the distal crossmember 18 for allowing adjustment of the receptacles 15 to accommodate horns 31 of different sizes.

I claim:

1. A cleat attachable device for attaching to a cleat having horns, the device comprising:

a frame having a base end, a distal end opposite said base end, a center post, and lateral posts, said lateral posts being disposed opposite one another and being connected to said center post, said lateral posts each having a respective outer edge opposite one another, said outer edges being spaced apart at said base end at a distance, said distance being at least as great as a length of the horns, and said center post having a mounting end projecting beyond said lateral posts at said base end, said mounting end being configured for mounting to the cleat, and a distal crossmember disposed at said distal end of said frame, said distal crossmember being attached to said center post, said lateral posts being attached at opposite ends of said distal crossmember.

2. The cleat attachable device according to claim 1, wherein said lateral posts converge together in a direction towards said distal end.

3. The cleat attachable device according to claim 2, wherein said lateral posts are mounted to one another and to said center post at said distal end.

4. The cleat attachable device according to claim 3, further comprising a crossmember disposed at said base end, said crossmember being attached to said lateral posts by opposite ends of said crossmember.

5. The cleat attachable device according to claim 4, wherein said lateral posts are pivotable with respect to one another about a pivot at said distal end and said crossmember has a length that is adjustable to accommodate different positions of said lateral posts.

6. The cleat attachable device according to claim 5, wherein said lateral posts each have a respective receptacle disposed at said base end, said receptacles each being configured for receiving respective ends of the horns therein.

7. The cleat attachable device according to claim 1, further comprising one-way line locking devices pivotably disposed at said base end, said one-way locking device being pivotable towards said center post.

8. The cleat attachable device according to claim 4, wherein said mounting end has two legs which straddle said crossmember, and configured to straddle the cleat.

9. The cleat attachable device according to claim 1, wherein each of said lateral posts has a respective receptacle disposed thereon at said base end, said receptacles being configured for receiving a respective end of the horn.

10. The cleat attachable device according to claim 9, wherein said mounting end has two legs configured to straddle the cleat.

11. A cleat attachable device for attaching to a cleat, the cleat having horns, the device comprising:

a frame having a base end, a distal end opposite said base end, and opposing lateral posts extending between said base end and said distal end, said lateral posts each having a respective outer edge opposite one another, said outer edges being spaced apart at said base end at a distance, said distance being at least as great as a length of the horns, said lateral posts each having a respective receptacle disposed at said base end, said receptacles each being configured for receiving respective ends of the horns therein;

a mounting device connected to said lateral posts and projecting beyond said lateral posts in a direction away from said base end.

12. The cleat attachable device according to claim 11, wherein said lateral posts converge together in a direction towards said distal end.

13. A cleat attachable device for attaching to a cleat having horns, the device comprising:

a frame having a base end, a distal end opposite said base end, a center post, and lateral posts, said lateral posts being disposed opposite one another and being connected to said center post, said lateral posts each having a respective outer edge opposite one another, said outer edges being spaced apart at said base end at a distance, said distance being at least as great as a length of the horns, and said center post having a mounting end projecting beyond said lateral posts at said base end, said center post defining two legs configured for straddling the cleat and said mounting end being configured for mounting to the cleat, and a distal crossmember disposed at said distal end of said frame, said distal crossmember being attached to said center post, said lateral posts being attached at opposite ends of said distal crossmember.

14. The cleat attachable device according to claim 13, further comprising a fastening element passing between said two legs.

15. A cleat attachable device for attaching to a cleat having horns defining a top of the cleat and a mounting foot having a base, a height of the cleat being defined by a length from the base to the top of the cleat, the device comprising:

a frame having a base end, a distal end opposite said base end, a center post, and lateral posts, said lateral posts being disposed opposite one another and being connected to said center post, said lateral posts each having a respective outer edge opposite one another, said outer edges being spaced apart at said base end at a distance, said distance being at least as great as a length of the horns, and said center post having a mounting end projecting beyond said lateral posts at said base end by a length distance, said length distance being less than the height of the cleat and configured for disposing ends of said lateral posts below the top of the cleat when the device is attached to the cleat, said mounting end being configured for mounting to the cleat.

* * * * *